United States Patent [19]

Kurotori et al.

[11] Patent Number: 4,860,050

[45] Date of Patent: Aug. 22, 1989

[54] DEVELOPING REPLENISHER MATERIAL FOR USE IN IMAGE FORMING DEVICE

[75] Inventors: Tsuneo Kurotori, Tokyo; Manabu Mochizuki; Kenzo Ariyama, both of Yokohama; Shinichi Kuramoto, Numazu; Yoshihiro Sugiyama, Mishima; Hajime Takanashi, Numazu; Takashi Ishizuka, Matsudo; Yoshio Kudo; Yoshio Sato, both of Shibata, all of Japan

[73] Assignee: Ricoh Company, Ltd., Tokyo, Japan

[21] Appl. No.: 78,670

[22] Filed: Jul. 28, 1987

[30] Foreign Application Priority Data

| | | | |
|---|---|---|---|
| Jul. 28, 1986 | [JP] | Japan | 61-177073 |
| Jul. 28, 1986 | [JP] | Japan | 61-177074 |
| Sep. 29, 1986 | [JP] | Japan | 232722 |
| Oct. 27, 1986 | [JP] | Japan | 255354 |
| Oct. 27, 1986 | [JP] | Japan | 255355 |
| Oct. 27, 1986 | [JP] | Japan | 255356 |

[51] Int. Cl.[4] ..... G03G 15/10

[52] U.S. Cl. ..... 355/256; 355/260; 106/32; 430/115

[58] Field of Search ..... 355/10, 3 R, 14 R; 106/32, 218, 270, 271, 272, 224, 227, 228, 229, 230; 430/115, 112, 113

[56] References Cited

U.S. PATENT DOCUMENTS

| | | | |
|---|---|---|---|
| 4,264,699 | 4/1981 | Tsubuko et al. | 430/115 X |
| 4,360,580 | 11/1982 | Tsubuko et al. | 430/115 X |
| 4,388,395 | 6/1983 | Tsubuko et al. | 430/115 X |
| 4,614,699 | 9/1986 | Kitatani et al. | 430/115 |
| 4,618,558 | 10/1986 | Kuramoto et al. | 430/115 |
| 4,640,605 | 2/1987 | Ariyama et al. | 355/10 X |
| 4,690,881 | 9/1987 | Nagai et al. | 430/115 X |
| 4,720,731 | 1/1988 | Suzuki et al. | 355/10 |
| 4,764,447 | 8/1988 | Tsubuko et al. | 430/115 |

*Primary Examiner*—A. C. Prescott

*Attorney, Agent, or Firm*—Oblon, Spivak, McClelland, Maier & Neustadt

[57] ABSTRACT

A developing replenisher material or a replenisher liquid developer to be supplied to a developer tank of an electrostatic copying machine comprises 1000 parts by weight of a carrier liquid composed mainly of aliphatic hydrocarbon and 200 or 1200 parts by weight of toner particles composed mainly of a binder resin and a pigment. The toner concentration of the replenisher liquid developer is high enough to prevent an overflow from the developer tank, allow many copies to be produced by the copying machine, and prevent a solvent shock. The toner particles, when added to the carrier liquid, can immediately and well be dispersed in the carrier liquid.

52 Claims, 10 Drawing Sheets

DEVELOPING REPLENISHER MATERIAL FOR USE IN IMAGE FORMING DEVICE

BACKGROUND OF THE INVENTION

The present invention relates to a developing replenisher material for use in a image forming device, e.g., electrostatic copying machine.

1. Discussion of the Background

In some electrophotographic copying machines, a photosensitive drum is held in contact with a liquid developer comprising a toner carrier liquid with toner particles dispersed therein thereby to cause the toner particles to be electrostatically attracted to an electrostatic latent image on the photosensitive drum to develop the latent image into a visible image.

The liquid developer is supplied onto the photosensitive drum from a developer tank through a supply nozzle of an image developing container. As toner particles in the liquid developer are consumed by being electrostatically attracted to the latent image on the photosensitive drum, the amount of toner particles in the developer tank is reduced, and the developer tank is replenished with new toner particles from a toner replenishing device to make up for the consumed toner particles.

The toner particles are replenished in the form of ink-type replenisher toner containing toner particles and a toner carrier liquid which are mixed at a ratio of 11:89, for example. The toner particles in the replenisher toner as they are mixed into the liquid developer stabilize the density of the liquid developer.

When many copies are successively produced or an original with a solid image at a large image area ratio is copied, the amount of consumed toner particles is increased. Therefore, an increased amount of replenisher toner should be added to compensate for the toner particle shortage for stabilizing the density of the liquid developer. Since the proportion of the toner carrier liquid is much larger than that of the toner particles in the replenisher toner, as described above, the total amount of toner carrier liquid in the liquid developer is increased of necessity as the replenisher toner is added to the liquid developer. Continued supply of a toner carrier liquid to the developer tank thus results in an overflow of the toner carrier liquid from the developer tank.

One solution to prevent such an overflow has been to provide a sensor in the developer tank for detecting the level of the liquid developer to limit the amount of liquid developer that can be stored in the developer tank. More specifically, when the amount of the liquid developer in the developer tank reaches a prescribed level, the sensor is activated to stop the operation of the toner replenishing device. Where the developer tank is of a small size and hence of a small capacity, however, the sensor will shut off the toner replenishing device soon since the liquid developer will quickly arrive at the preset level as new toner is replenished, especially when a relatively large solid image is copied Consequently, it is difficult to keep the liquid developer in the developer tank at a desired mixture ratio.

SUMMARY OF THE INVENTION

It is an object of the present invention to provide a developing replenisher material such as a replenisher liquid developer or a replenisher carrier liquid, which is capable of producing many copies of good quality.

According to the present invention, a developing replenisher material to be supplied to a developer tank of an electrostatic copying machine comprises 1000 parts by weight of a carrier liquid composed mainly of aliphatic hydrocarbon and 200 to 1200 parts by weight of toner particles composed mainly of a binder resin and a pigment.

The developing replenisher material, or liquid developer, which is of a concentrated nature, prevents an overflow from the developer tank and allows many copies to be produced by the copying machine. The toner particles, when added to the carrier liquid, can immediately and well be dispersed in the carrier liquid. The present invention is more effective where the replenisher carrier liquid is combined with the concentrated liquid developer.

The above and other objects, features and advantages of the present invention will become more apparent from the following description when taken in conjunction with the accompanying drawings in which preferred embodiments of the present invention are shown by way of illustrative example.

DETAILED DESCRIPTION THE PREFERRED EMBODIMENTS

Figure 1:
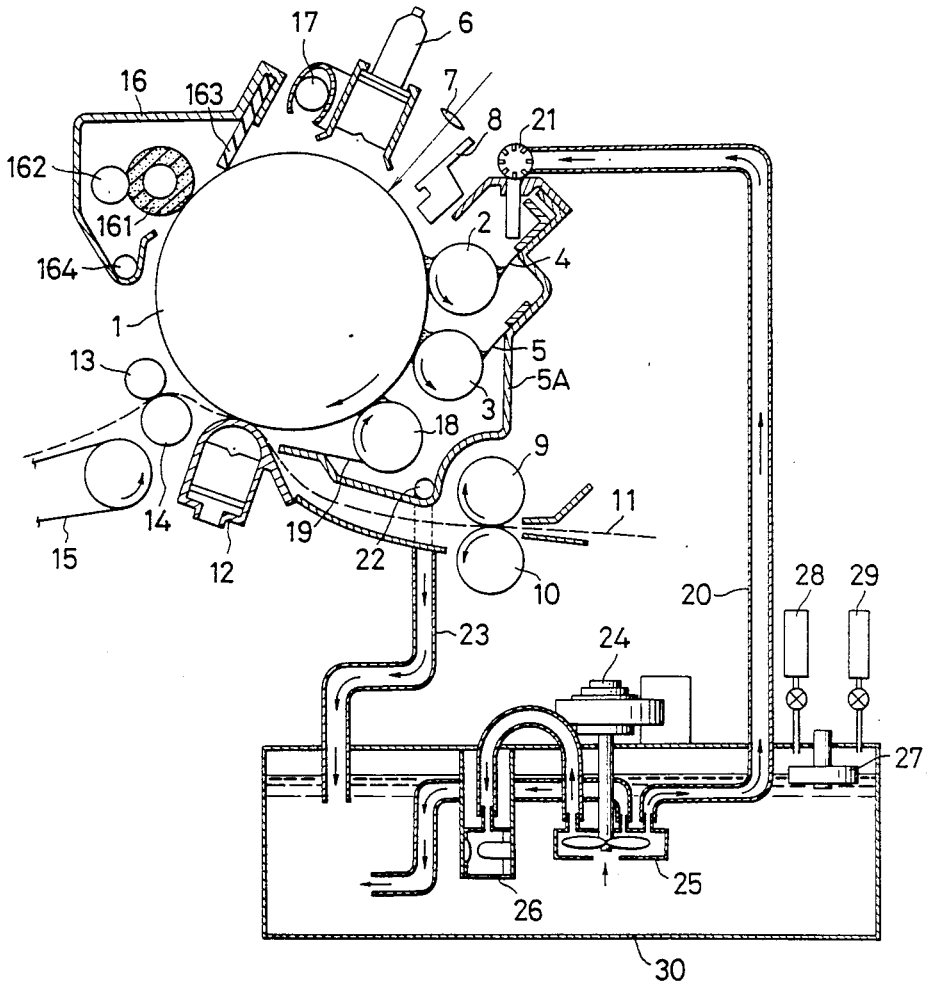
FIG. 1 is a schematic cross-sectional view of a wet-type electrophotographic copying machine suitable for use with a developing replenisher material according to the present invention.

FIG. 1 schematically shows a wet-type electrophotographic copying machine including a photosensitive drum 1 forming thereon an electrostatic latent image. The electrostatic latent image is developed by a liquid developer held on developing rollers 2, 3 spaced slightly from the photosensitive drum 1 and rotating about their own axes. The developing rollers 2, 3 are cleaned at all times by scrapers 4, 5, respectively, slidably held against the circumferential surfaces of the developing rollers 2, 3.

During a copying process, the photosensitive drum 1 is rotated about its own axis in the direction of the arrow by a drive device (not shown), and is uniformly charged by a main charger 6. Thereafter, an image to be copied is projected onto the photosensitive drum 1 through an optical system 7 to form an electrostatic latent image on the drum 1. Any charge on the region of the photosensitive drum 1, other than the image region, is removed by an eraser 8.

The electrostatic latent image is developed into a visible toner image by a wet-type developing unit having the developing rollers 2, 3, and the toner image is transferred by a transfer charger 12 onto a transfer sheet 11 such as of plain paper which has been fed by feed rollers 9, 10 from a paper feeder (not shown) along the dotted line. The transfer sheet 11 with the toner image carried thereon is separated from the photosensitive drum 1 by separator rollers 13, 14, and conveyed by a feed belt 15 toward an image fixing unit (not shown).

After the transfer sheet 11 has been separated from the photosensitive drum 1, any remaining liquid developer is removed from the drum 1 by a cleaning unit 16. Then, remaining charges are removed from the drum 1 by a charge-removal unit such as a charge-removal lamp 17 or a charge-removal charger. The cleaning unit 16 comprises a cleaning foam roller 161, a squeeze roller 162, and a scraper 163. The remaining liquid developer collected by the cleaning unit 16 is discharged out through a retrieval hole 164.

The developing unit also includes a squeeze roller 18 and a scraper 19 held against the squeeze roller 19. One or more developing rollers may be employed, and the developing rollers 2, 3 are preferably spaced from the photosensitive drum 1 by a gap ranging from 0.1 to 0.3 mm. The squeeze roller 18 and the drum 1 are preferably spaced from each other by a gap in the range of from 0.05 to 0.09 mm. The developing rollers 2, 3 are rotated by a drive device (not shown) at a peripheral speed higher than that of the photosensitive drum 1, and the squeeze roller 18 is rotated at a higher peripheral speed in a direction such that confronting surfaces of the drum 1 and the roller 18 move in opposite directions. The liquid developer is supplied to and circulated through the developing unit through a supply pipe 20, a supply nozzle 21, a retrieval hole 22, and a retrieval pipe 23. The liquid developer is contained in a developer tank 30 housing a pump 25 driven by a pump motor 24, a liquid developer density sensor 26, and a float switch 27 serving as a level sensor. The developer tank 30 is connected to a replenisher liquid developer tank 28 and a replenisher carrier liquid tank 29.

The developer tank 30 was supplied with 960 ml of a liquid developer (comprising 1000 parts by weight of a carrier liquid composed of Isopar H and 90 parts by weight of toner), and 1000 copies of a solid black original of B-4 size were reproduced. As a result, the liquid developer was increased by 2300 ml. If the copying process had gone on, the problems referred to above would have been caused. As a replenisher liquid developer, there was employed a conventional liquid developer comprising 1000 parts by weight of a carrier liquid and 50 to 120 parts by weight of toner dispersed in the liquid carrier. When the toner density in the liquid developer contained in the developer tank 30 is reduced below a prescribed level as detected by the density sensor 26, a new replenisher liquid developer is supplied to the developer tank 30 from the replenisher liquid developer tank 29.

Then, a replenisher liquid developer comprising 1000 parts by weight of a carrier liquid with 200 parts by weight of toner dispersed therein (i.e., a concentrated-toner replenisher liquid developer) was employed, and the same copying process as above was carried out. As a result, the liquid developer was increased by 1000 ml which is less than half 2300 ml. When an original with an image area ratio of 20% was copied, the liquid developer was held in equilibrium, i.e., was not increased or reduced. Therefore, it was found that the concentrated replenisher liquid developer could well be used for copying average originals having an image area ratio ranging from 5 to 7%.

The same experiments were carried out by copying originals of different image area ratios and using replenisher liquid developers of different toner densities. As a consequence, it was found that by employing, as a replenisher liquid developer, a concentrated-toner liquid developer comprising 1000 parts by weight of a carrier liquid composed mainly of aliphatic hydrocarbon and 200 to 1200 parts by weight of toner dispersed in the carrier liquid, many clear copies of good image density could be produced without causing an overflow of the liquid developer from the developer tank 30. Where this replenisher liquid developer is used, the toner particles are consumed while preventing unnecessary solvent consumption, and hence an economical developing process can be accomplished.

The toner dispersed in the liquid carrier of the replenisher liquid developer according to the present invention is composed mainly of a pigment and a binder resin.

The pigment or colorant may be an inorganic pigment such as (i) Printex B, Printex V, Printex U, Special black 15, or Special black 4 manufactured by Degussa, (ii) #44, #30, MR-11, or MA-100 manufactured by Mitsubishi Chemical Industries, Ltd., (iii) Morgal L, Black pearl 1300, Black pearl 1100, Black pearl 900, Regal 400, or Regal 660 manufactured by Cabot Corp., or (iv) Neospectra II, Robin 1035, or Robin 1252 manufactured by Columbian Chemicals, or an organic pigment such as phthalocyanine blue, phthalocyanine green, sky blue, Rhodamine Lake, Malachite Green Lake, Methyl Violet Lake, Peacock Blue Lake, Naphthol Green B, Naphthol Green Y, Naphthol Yellow S, Lithol Fast Yellow 2G, Permanent Red 4R, Brilliant Fast Scarlet, Hansa Yellow, Benzidine Yellow, Lithol Red, Lake Red C, Lake Red D, Brilliant Carmine 6B, Permanent Red F5R, Pigment Scarlet 3B, indigo, thioindigo, oil pink, or Bordeaux 10B.

The binder resin may be a copolymer or a graft copolymer with a vinyl monomer A expressed by the following general formula (I):

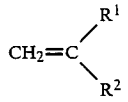

(I)

where $R^1$ indicates hydrogen or a methyl group and $R^2$ indicates $COOC_nH_{2+1}$ (n is an integer of 6 to 20), and vinyl monomer, vinyl pyridine, vinyl pyrrolidone, ethylene glycol dimethacrylate, styrene, divinyl benzene, or vinyltoluene (monomer B) expressed by the following general formula (II)

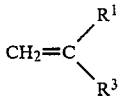

(II)

where $R^1$ indicates hydrogen or a methyl group and $R^3$ indicates $COOC_nH_{2+1}$ (n is an integer of 1 to 5),

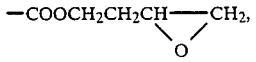

—COOH, —$COOCH_2CH_2OH$, —$COOCH_2CH_2N(CH_3)_2$, or —$COOCH_2CH_2N(C_2H_5)_2$.

The binder resin may also be (a) N-10, N-11, N-12, N-14, N-34, N-45, C-10, C-13, C-15, C-16, E-10, E-11, E-12, E-14, or E-15 manufactured by Eastman Chemical Products, Inc.,

110P, 220P, 220MP, 320MP, 410MP, 210MP, 310MP, 405MP, 200P, 4202E, or 4053E manufactured by Mitsui Petrochemical Ind., Ltd.

131P, 151P, 161P, 171P, E300, or E250P manufactured by Sanyo Chemical Ind., Ltd.,

H1, H2, A1, A2, A3 or A4 manufactured by Sazor, Inc.,

OA WAX or A WAX manufactured by BASF,

BARECO 500, BARECO 2000, E-730, E-2018, E-2020, E-1040, Petronaba C, Petronaba C-36, Petronaba C-400, or Petronaba C-7500 manufactured by Petrolite Corp.,

PE580, PE130, PED121, PED136, PED153, PED521, PED522, or PED534 manufactured by Hoechst, DYNI, DYNF, DYNH, DYNJ, or DYNK manufactured by Union Carbide Corp., ORIZON 805, 705, or 50 manufactured by Monsanto Co., ALATHON 3, 10, 12, 14, 16, 20, 22, or 23 manufactured by E. I. Dupont, AC polyethylene 6, 6A, or 615 manufactured by Allied Chemical Corp., synthetic polyethylene or polypropylene such as Everflex 150, 210, 220, 250, 260, 310, 60, 410, 420, 450, 460, 550, or 560 manufactured by Mitsui Polychemical Ind., Ltd., or their modified products, (b) natural wax such as carnauba wax, montan wax, candelilla wax, sugar cane wax, ouricouri wax, bees wax, Japan wax, or rice bran wax, (c) natural resin such as ester gum or hardened rosin, or (d) natural resin modified hardened resin such as natural resin modified maleic acid resin, natural resin modified phenolic resin, natural resin modified polyester resin, natural resin modified pentaerythritol resin, or epoxy resin.

The liquid developer of the invention is prepared by charging the colorant and the resin together with a suitable organic solvent (which may preferably be of aliphatic hydrocarbon) into a dispersing machine such as a ball mill, a kitty mill, a disk mill, a pin-type mill, or a vibrating mill, so that toner particles having a diameter ranging from 0.1 to 0.4 micrometer will be produced. Before the liquid developer is prepared, the colorant should preferably be treated by synthetic polyethylene, natural resin, or natural resin modified hardened resin.

The aliphatic hydrocarbon used as the carrier liquid may be Isopar L (having a boiling point ranging from 188° to 210° C.), Isopar M (having a boiling point ranging from 205°to 252° C.), Isopar G (having a boiling point ranging from 158° to 177° C.), or Isopar H (having a boiling point ranging from 174° to 190° C.) manufactured by Exxon Chemical Co., IP solvent 2028 (having a boiling point ranging from 210° to 265° C.), IP solvent 2835 (having a boiling point ranging from 275° to 350° C.), or IP solvent 1620 (having a boiling point ranging from 166° to 205° C.), manufactured by Idemitsu Petrochemical Co., Ltd., Isosol 400 (having a boiling point ranging from 206° to 257° C.) manufactured by Nisseki Chemical Co., Ltd., Isododecan (having a boiling point ranging from 176° to 185° C.) manufactured by BP Chemical, Inc., or isooctane or ligroin (both having a boiling point ranging from 120° to 190° C.).

When the concentrated replenisher liquid developer is charged into the developer tank containing a liquid developer of normal density and is diluted by the latter, a so-called solvent shock may be caused due to the large difference between the surfaces of the concentrated toner particles since the amount of the carrier liquid in the liquid developer which has originally been contained in the developer tank is large. If an image were developed by a liquid developer suffering a solvent shock, then the density of the image would be lowered, or a blurred image would be produced.

In order to ease or eliminate the solvent shock, it is preferable to mix ions in a replenisher carrier liquid, add the replenisher carrier liquid to the developer tank before the concentrated toner is charged, so that any change in the ion density of the concentrated toner particles will be reduced.

According to the present invention, therefore, at least one of a resin which is dissolvable in aliphatic hydrocarbon or a charge controlling agent is added to a replenisher carrier liquid which is mainly composed of aliphatic hydrocarbon.

The resin dissolvable in the aliphatic hydrocarbon may be the binder resin as referred to above, and the charge controlling agent may be a metal salt such as manganese naphthenate, or a resin-base controlling agent such as a rosin modified resin, or natural oil such as linseed oil, for example. Preferably, 0.01 to 1.0 weight % of the resin dissolvable in the aliphatic hydrocarbon and/or the charge controlling agent should be added to the carrier liquid.

The solvent (aliphatic hydrocarbon) having a boiling point ranging from 120° to 190° C. is employed in the replenisher liquid developer and the replenisher carrier liquid, which are stored in containers for sale in the market. Where the solvent having the above boiling point range is used, copied images can be dried to a satisfactory degree. If the inlet/outlet opening of the container containing the replenisher liquid developer remained open, the surface of the contained liquid developer held in contact with air would be dried, making it difficult to replenish the concentrated toner (replenisher liquid developer). Using a solvent having a boiling point higher than 190° C. would prevent the concentrated toner from being dried, but would not allow a copied image to be well dried.

According to the present invention, therefore, it is preferable to use a replenisher liquid developer of the invention which comprises 1000 parts by weight of a carrier liquid composed mainly of aliphatic hydrocarbon and including at least 500 weight % thereof having a boiling point of 190° C. or higher, and 200 to 1200 parts by weight of toner composed mainly of a binder resin and a pigment and dispersed in the carrier liquid, in combination with a replenisher carrier liquid composed mainly of aliphatic hydrocarbon having a boiling point in the range of from 120° C. to 190° C., for permitting the concentrated toner to be well replenished without difficulty.

The aliphatic hydrocarbon having a boiling point ranging from 120° to 190° C. and the aliphatic hydrocarbon having a boiling point of 190° C. or higher may be selected from those referred to above.

Examples will be described below. Percents referred to below are percents by weight.

EXAMPLE 1

Liquid of Isopar H with a methylmethacrylate/stearyl methacrylate/hydroxyethyl methacrylate/mechacrylic acid (10/80/10/10), copolymer dispersed therein (solid portion: 33%) 600 parts Pigment comprising 300 parts of carbon black (Printex U manufactured by Degussa, 200 parts of natural resin modified maleic acid (Tescon MRP manufactured by Tokushima Oil Refinery Co., Ltd.), and 600 parts of polyethylene (171P manufactured by Sanyo Chemical Ind., Ltd., which are kneaded by three-roll mill 1000 parts Isopar H (manufactured by Exxon Chemical 2400 parts)

The above materials were kneaded by a pin-type mill to produce a replenisher liquid developer with concentrated toner (Inventive example 1).

100 parts of the concentrated toner were added to and dispersed in 200 parts of Isopar H to produce a product (Comparative example 1). 100 parts of the concentrated toner were added to and dispersed in 750 parts of Isopar H to produce a product (Comparative example 2).

EXAMPLE 2

Liquid of Isododecan with a methylmethacrylate/-lauryl methacrylate/glycidyl methacrylate/acrylic acid (12/80/10/8) copolymer dispersed therein (solid portion: 25%) 800 parts Pigment comprising 300 parts of carbon black (Robin 1252 manufactured by Columbian Chemicals) and 700 parts of carnauba wax which are kneaded by a three-roll mill 1200 parts Isododecan (manufactured by BP Chemical Co.) 2000 parts The above materials were kneaded by a disk mill to produce concentrated toner (Inventive example 2).

100 parts of the concentrated toner were added to and dispersed in 80 parts of Isododecan to produce a product (Comparative example 3). 100 parts of the concentrated toner were added to and dispersed in 750 parts of Isododecan to produce a product (Comparative example 4).

The Comparative examples 2 and 4 contained much agglomerate, and images reproduced by using them were of low density and resulted in surface roughness. The remaining four examples or samples were put into the replenisher liquid developer tank 28 of the wet-type electrophotographic copying machine as shown in FIG. 1 (CT 5085 manufactured by Ricoh Co., Ltd.), and the same liquid developers as the samples (except for solid portion densities given in Table 1) were contained in the developer tank 29. A two-mode copying test was carried out in which 2000 copies were successively produced (mode a) and 400 copies a day were produced for five days (mode b). The results of the test are indicated in Table 1 below.

TABLE 1

| | Inventive example 1 | Inventive example 2 | Comparative example 1 | Comparative example 2 |
|---|---|---|---|---|
| Solid portion per 1000 parts of carrier liquid | 430 parts | 250 parts | 111 parts | 125 parts |
| Black 5% | | | | |

TABLE 1-continued

| | Inventive example 1 | Inventive example 2 | Comparative example 1 | Comparative example 2 |
|---|---|---|---|---|
| area 10% | | | x | |
| on 20% | | | x | x |
| chart 30% | | | x | x |

Note:
The mark indicates that no problem occurred irrespective of which copy mode might be selected. The mark means that no problem was caused in the mode b. but the float switch 27 was actuated to stop operation of the machine. The mark x represents that the float switch 27 is operated no matter which copy mode might be selected.

EXAMPLE 3

Liquid of Isopar H with a methylmethacrylate/lauryl methacrylate/glycidyl methacrylate/methacrylic acid (10/80/10/10) copolymer dispersed therein (solid portion: 20%) 600 parts Pigment comprising 300 parts of carbon black (Special black 4B manufactured by Degussa and 700 parts of polyethylene (AC polyethylene manufactured by Allied Chemical Corp.) which were mixed, flushed in a flusher, and then ground 400 parts Isododecan (manufactured by BP Chemical Co.)

The above materials were dispersed by a ball mill, and 2000 parts of Isododecan were additionally dispersed therein. The dispersion was separated by a filter into a cake having 30% of a solid portion and a filtered liquid. To 100 parts of the filtered liquid were added 500 parts of Isododecan to produce a diluting carrier liquid (Carrier liquid 1). The cake was used as concentrated toner (Inventive example 3).

EXAMPLE 4

Liquid of Isopar with a methylmethacrylate/lauryl methacrylate/hydroxyethyl methacrylate/acrylic acid (10/80/10/10) copolymer dispersed therein (solid portion: 33%) 600 parts Pigment comprising 300 parts of carbon black (Morgal L manufactured by Cabot Corp., 200 parts of wax (OA WAX manufactured by BASF, and 200 parts of carnauba wax which were mixed, flushed in a flusher, and then ground 1000 parts Isopar H 2400 parts The above materials were kneaded by a pin-type mill to produce concentrated toner (Inventive example 4).

Liquid of Isopar H with a lauryl methacrylate/glycidyl methacrylate/vinylpyridine/acrylic acid (80/5/5/10) (10% density) 100 parts Isopar H 1400 parts The above materials were mixed to produce a diluting carrier liquid (Carrier liquid 2).

The Inventive example 3 was diluted by the Carrier liquid 1, and the Inventive example 4 was diluted by the Carrier liquid 2, to produce liquid developers. The liquid developers were contained in the developer tank 29 and supplied for copying. Development troubles such as a lower image density, a blurred image, and the like were not caused by any of the liquid developers either immediately after the dilution or 3 hours after the dilution.

Figure 2:
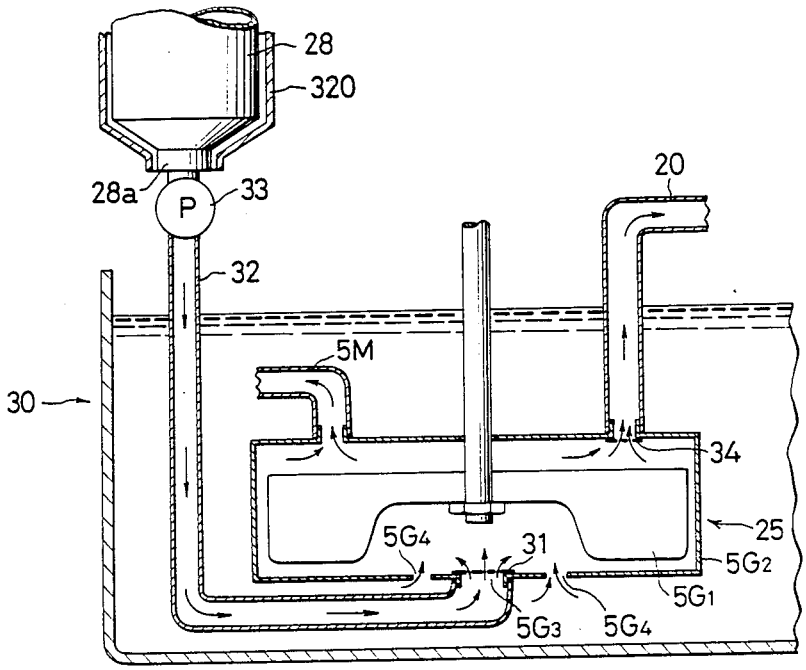
FIG. 2 is a fragmentary cross-sectional view of means for dispersing a replenisher liquid developer in a developer tank.

FIG. 2 shows dispersing means for dispersing a developing replenisher material or a replenisher liquid developer in a liquid developer. A pump 25 disposed in a developer tank 30 has a pump chamber 5G2 housing rotary vanes 5G1 and having an inlet port 5G3 defined centrally in its bottom wall. A mesh screen 31 is attached to the bottom wall of the pump chamber 5G2 across the inlet port 5G3. An inlet pipe 32 is connected at one end to the outer surface of the bottom wall of the pump chamber 30 in communication with the inlet port 5G3. The other end of the inlet pipe 32 is connected to a supply pump 33 with its inlet side coupled to an opening 28*a* of a replenisher liquid developer tank 28.

The tank 28 is held in a funnel-shaped receiver 320 and has its opening 28*a* directed downwardly. The tank 28 contains therein a replenisher liquid developer of the present invention which comprises 1000 parts by weight of a toner carrier liquid and 200 to 1200 parts by weight of toner particles dispersed in the toner carrier liquid.

The pump chamber 5G2 has an upper wall to which there are connected an end of a pipe 20 coupled to the supply nozzle 21 (FIG. 1) of a developing container 5A, and an end of a pipe 5M for returning the liquid developer into the developer tank 30.

The bottom wall of the pump chamber 5G2 also has a plurality of inlet holes 5G4 defined around the inlet port 5G3 for introducing the liquid developer in the developer tank 30 into the pump chamber 5G2.

When toner particles are to be replenished, the supply pump 33 is operated to feed the replenisher liquid developer under pressure from the replenisher tank 28 into the pump chamber 5G2.

Since the rotary vanes 5G1 of the pump 25 are also rotated at this time, the replenisher liquid developer is drawn into the pump chamber 5G2 and filtered by the mesh screen 31 as the replenisher liquid developer passes through the inlet port 5G3. The toner particles in the replenisher liquid developer are broken up into smaller toner particles by the mesh screen 31, which are then stirred by the rotary vanes 5G1 and broken into smaller toner particles.

While the rotary vanes 5G1 are being rotated, the liquid developer in the developer tank 30 is also drawn through the inlet holes 5G4 into the pump chamber 5G2, so that the toner particles are dispersed in the liquid developer.

The liquid developer with the replenisher toner particles dispersed therein is then fed under pressure through the pipe 20 into the developing container 5A and also delivered through the pipe 5M back into the developer tank 30.

Another mesh screen 34 is also attached to the upper wall of the pump chamber 5G2 across the opening connected to the pipe 20, the mesh screen 34 being of a smaller mesh size than that of the mesh screen 31. Therefore, the toner particles in the liquid developer as it flows toward the developing container 5A through the pipe 20 have a smaller diameter.

The toner particles in the liquid developer are broken up into smaller toner particles by the mesh screens 31, 34 and the rotary vanes 5G1, and hence no special means for breaking the toner particles into smaller toner particles is required.

With the arrangement shown in FIG. 2, the toner particles in the replenisher liquid developer can well be dispersed simply by connecting the inlet pipe 32 to the pump chamber 5G2 of the pump 25. Inasmuch as the toner in the replenisher liquid developer is concentrated or has a higher density, the density of the resultant liquid developer can be stabilized by replenishing a smaller amount of replenisher liquid developer. Therefore, the toner carrier liquid which is also supplied when the replenisher liquid developer is replenished is prevented from greatly increasing in quantity, so that the amount of toner carrier liquid newly added to the liquid developer in the developer tank 30 can be reduced. The rate at which the level of the liquid developer in the developer tank 30 is consequently lowered. Accordingly, the interval or time period until the liquid level reaches a preset level in the developer tank 30 to stop replenishing operation can be increased. Since the toner concentration in the replenisher liquid developer is high, the replenisher liquid developer is less liable to be scattered around as when the replenisher tank 28 is attached, whereby operator's hands or areas surrounding the replenisher tank 28 are prevented from being smeared by the replenisher liquid developer.

Figure 3:
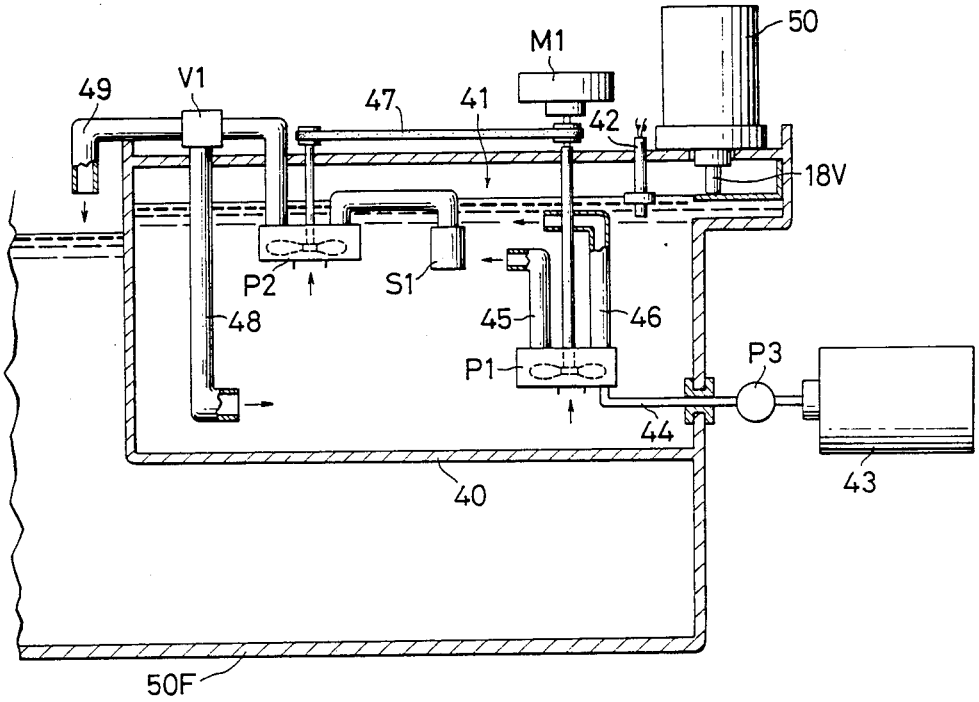
FIG. 3 is a cross-sectional view of a separate chamber in the developer tank for promoting the dispersion of the liquid developer.

FIG. 3 shows another arrangement in which a separate chamber 41 is defined by a partition 40 disposed in a developer tank 50F which contains a liquid developer having such a density as to be able to develop an electrostatic latent image. The separate chamber 41 contains a liquid developer to be supplied to the developer tank 50F.

The level of the liquid developer in the separate chamber 41 is monitored by a float switch 42, which will displays an alarm signal on a control panel of the copying machine when the liquid developer level varies beyond prescribed upper and lower limits. Two rotary pumps P1, P2 are disposed in the liquid developer in the separate chamber 41.

The pump P1 serves to draw the liquid developer in the separate chamber 41 and also draw a developing replenisher material or a replenisher liquid developer of higher toner concentration via a pipe 44 from a replenisher liquid developer tank or bottle 43 in response to operation of a pump P3 on the pipe 44. The pump P1 stirs the liquid developer in the separate chamber 41 and the replenisher liquid developer from the tank 43 in a pump casing, while dispersing the toner particles of the replenisher liquid developer in the carrier liquid in the separate chamber 40, and discharges the resultant liquid developer through outlet pipes 45, 46 into the liquid developer in the separate chamber 40. Therefore, the liquid developer in the separate chamber 40 is of lower toner concentration than that of the replenisher liquid developer from the tank 43.

The pump P1 is driven by the shaft of a motor M1 on which a pulley is mounted. A belt 47 is trained around this pulley and another pulley on the shaft of the pump P2, so that the pumps P1, P2 operate in synchronism with each other.

The pump P2 serves to draw the liquid developer in the separate chamber 41 and discharge the liquid developer through a density sensor S1 into the separate chamber 41. The liquid developer in the separate chamber is also drawn by the pump P2 and selectively directed by a solenoid-operated two-way valve V1 to flow through an outlet pipe 48 back into the separate chamber 40 or through an outlet pipe 49 into the developer tank 50F.

The density sensor S1 detects the toner density in the separate chamber 41. When the toner density is lower than a prescribed reference level to be met by the replenisher liquid developer in the separate chamber 40, the density sensor S1 issues a signal to actuate the pump P3 for supplying the replenisher liquid developer of higher toner concentration from the tank 43 into the separate chamber 41. When the desired toner density level is achieved, the pump P3 stops its operation.

The pumps P1, P2 are rotated at all times. Therefore, the pump P1 may only stir the liquid developer in the separate chamber 41 or both stir the same and supply the replenisher liquid developer from the tank 43.

The pump P2 can discharge the liquid developer through the outlet pipe 48 to stir the same in the separate chamber 41, or supply the liquid developer through the outlet pipe 49 into the developer tank 50F, in response to switching operation of the solenoid-operated valve V1. The solenoid-operated valve V1 is controlled by a signal from a density sensor (not shown) in the developer tank 50F.

Instead of the solenoid-operated valve V1, an overflow control system may be employed to control the supply of the liquid developer into the developer tank 50F.

A replenisher carrier liquid tank 50 containing a replenisher toner carrier liquid is disposed above one side of the separate chamber 41, the tank 50 having its outlet directed downwardly. The tank 50 automatically replenishes the separate chamber 40 with the toner carrier liquid through a chicken feed valve 18V according to the liquid level in the separate chamber 40.

The separate chamber 40 including the pump P1, the pipes 45, 46 serve as dispersing means for dispersing the toner particles of the replenisher liquid developer of higher toner concentration in the toner carrier liquid to produce the liquid developer of lower toner concentration, which will be supplied to the liquid developer in the developer tank 50F.

Figure 4:
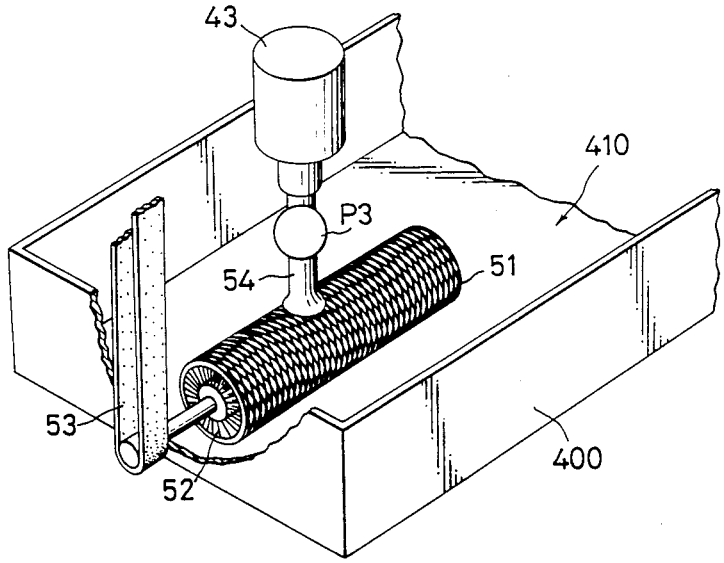
FIGS. 4, 5, 6, 8, 12, 14, 16, 17, 19, and 20 are views of means each for dispersing a replenisher liquid developer in a separate chamber.

FIG. 4 shows dispersing means according to another embodiment of the present invention. A cylindrical member 51 having an outer peripheral wall of a mesh structure is fixed by a liquid developer contained in a separate chamber 410 defined by a partition 400 disposed in a developer tank similar to the developer tank 50F shown in FIG. 3. A rotatable cylindrical brush 52 is fitted in the cylindrical member 51 and is rotatable about its own axis by a belt 53, the brush 52 having bristles of 20 denier/10 filler at a density of 500/square inches.

A pipe 54 is connected at its lower end to the upper center of the cylindrical member 51 and has the upper end connected through a pump P3 to a tank or bottle 43 containing a replenisher liquid developer of higher toner concentration. The replenisher liquid developer fed from the tank 43 by the pump P3 is supplied into the cylindrical member 51, and the toner particles of the replenisher liquid developer thus supplied are dispersed again into the liquid developer in the separate chamber 410 by the rotating bristle brush 52 and the mesh wall of the cylindrical member 51. The replenisher liquid developer is thus dispersed through the holes of the mesh wall into the liquid developer in the separate chamber 410.

Since the rotatable brush 52 is a bristle brush, it applies a smaller torque than that which would be imposed by a sponge roller, and allows uniform dispersion of the replenisher liquid developer.

Figure 5:
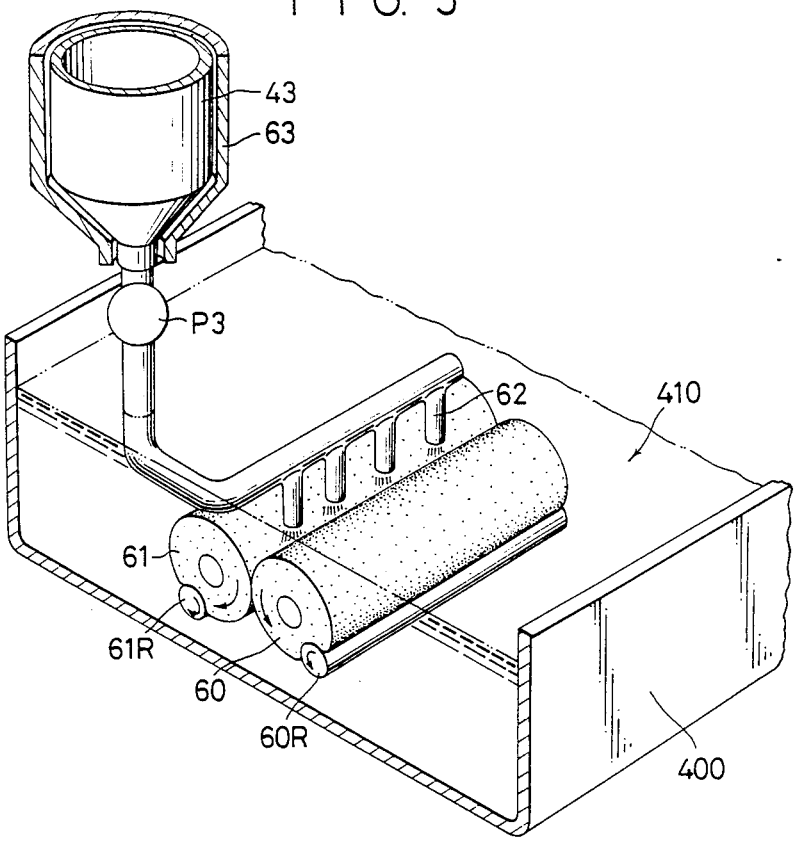

FIG. 5 shows dispersing means according to still another embodiment of the present invention. A pair of rotatable sponge rollers 60, 61 held in pressed engagement with each other is disposed in a liquid developer contained in a separate chamber 410. The sponge rollers 60, 61 are rotated about their respective own axes such that their contacting surfaces move downwardly.

Smaller-diameter squeeze rollers 60R, 61R are disposed obliquely below and pressed against the respective sponge rollers 60, 61. The squeeze rollers 60R, 61R are rotated such that their surfaces contacting the sponge rollers 60, 61 move in directions opposite to the directions in which the contacting surfaces of the sponge rollers 60, 61 move.

An array of equally spaced supply nozzles 62 is disposed above the area in which the sponge rollers 60, 61 confront each other, the supply nozzles 62 being directed downwardly. The supply nozzles 62 are connected through a pump P3 to a tank or bottle 43 held by a holder 63 and containing a replenisher liquid developer of higher toner concentration, so that the replenisher liquid developer can be supplied from the tank 43 to the sponge rollers 60, 61 by the pump P3.

The sponge rollers 60, 61 as they pressed against each other absorb and discharge the liquid developer in the separate chamber 410 and the replenisher liquid developer fed by the pump P3 to mix and disperse them into the liquid developer in the separate chamber 410. The squeeze rollers 60R, 61R assist the sponge rollers 60, 61 in absorbing and discharging the liquid developers and promoting the dispersion.

More specifically, the replenisher liquid developer is absorbed into the sponge rollers 60, 61 and spread widely therein. As the sponge rollers 60, 61 are elastically deformed under pressure upon pressed contact with each other, the replenisher liquid developer is discharged from the rollers 60, 61 and dispersed into the liquid developer in the separate chamber 410.

The dispersion by the sponge rollers 60, 61 generates less heat than the dispersion by a pump or the like. Further, the sponge rollers 60, 61 prevent the danger of excessive dispersion which would otherwise cause the toner particles to have an unduly reduced diameter below 0.2 micrometer.

Insofar as the supply nozzles 62 are directed to the sponge rollers and the sponge rollers are immersed in the liquid developer in the separate chamber 410, the number of sponge rollers used may be selected as desired. Although two or more sponge rollers may be used, their directions of rotation should be selected such that the replenisher liquid developer falling from the supply nozzles 62 will immediately be brought between the sponge rollers.

Figure 6:
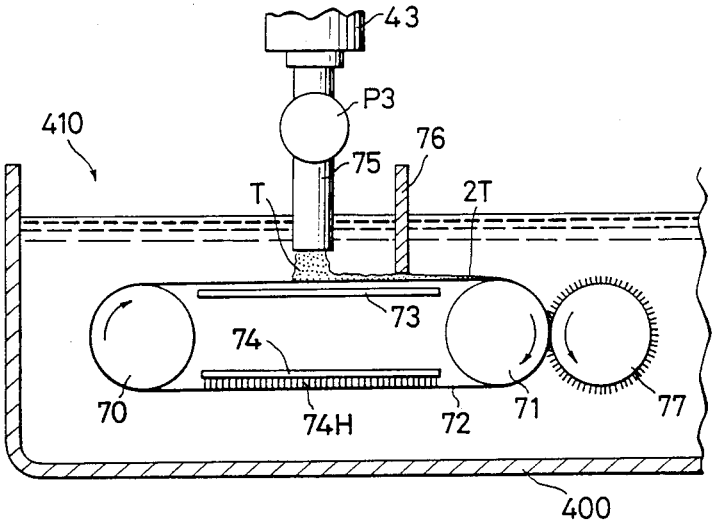
Figure 7:
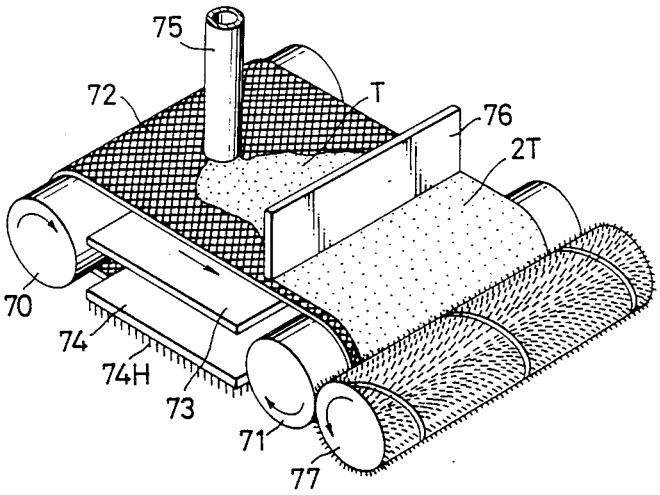
FIG. 7 is a perspective view of a portion of FIG. 6.
Figure 8:
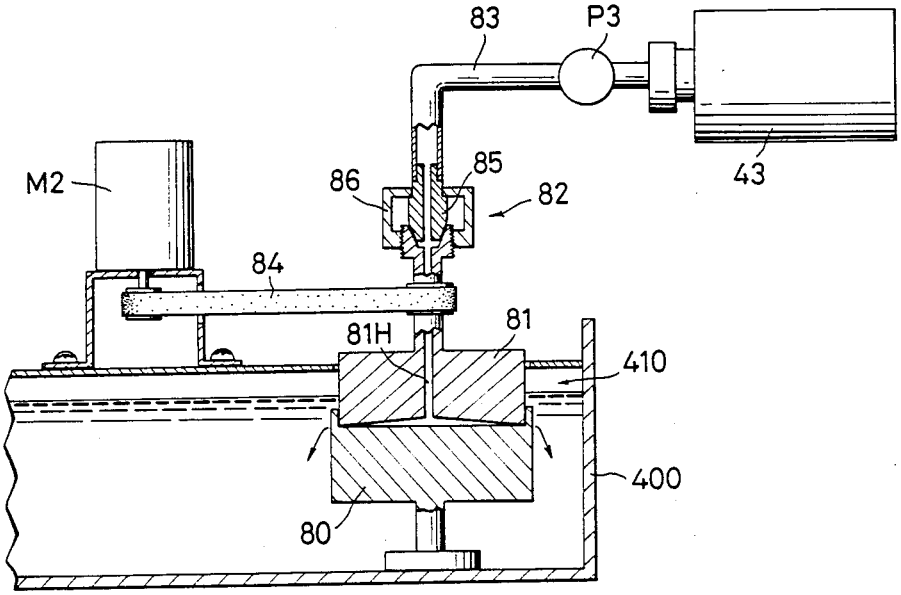
Figure 9:
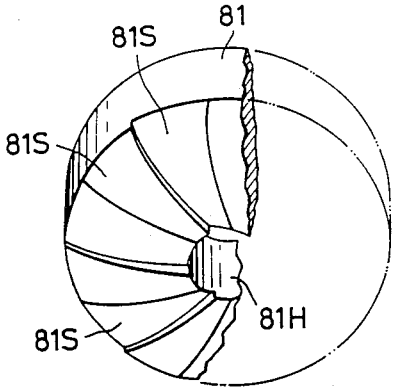
FIGS. 9 through 11 are perspective views of portions of FIG. 8.
Figure 10:
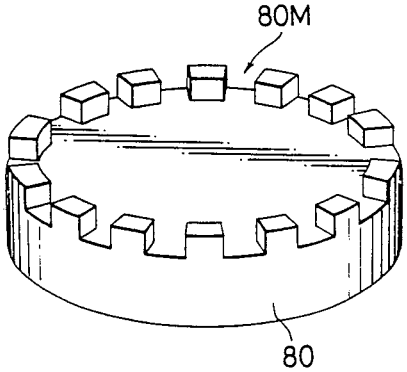

FIGS. 6 and 7 illustrate dispersing means according to a further embodiment of the present invention. In this embodiment, a pair of spaced rotatable rollers 70, 71 is disposed in confronting relation within a liquid developer contained in a separate chamber 410. A mesh belt 72 is trained around the rollers 70, 71 for movement in the direction of the arrow (FIG. 7) upon rotation of the rollers 70, 71. A guide plate 73 is disposed below and near an upper run of the belt 72, and a plate 74 is disposed above and near a lower run of the belt 72. The lower surface of the plate 74 which faces the belt 72 is flocked with flocks or fibers 74H held in contact with the lower run of the belt 72.

A pipe 75 is positioned above the center of the upper run of the belt 72 and between the rollers 70, 71, the pipe 75 being coupled via a pump P3 to a tank or bottle 43 containing a replenisher liquid developer of higher toner concentration.

A blade 76 fixed to a stationary member (not shown) is positioned downstream of the pipe 75 in the direction in which the upper run of the belt 72 travels, the blade 76 having a lower edge spaced slightly from the upper surface of the upper run of the belt 72. A bristle brush roller 77 is disposed in contact with the roller 72 near the blade 76 so as to be rotatable by contact with the roller 72.

When a signal from a density sensor in the developer tank is issued, the pump P3 is actuated to supply the replenisher liquid developer from the tank 43 onto the belt 72 at T. The supplied replenisher liquid developer T is spread by the blade 76 substantially uniformly over the belt 72 at 2T, and then scattered and dispersed into the liquid developer in the separate chamber 410 by the bristle brush roller 77. Any remaining replenisher liquid developer 2T on the belt 72 is dispersed into the liquid developer in the separate chamber 410 by the flocked fibers 74H on the plate 74.

As shown in FIG. 7, the bristles of the brush roller 77 are formed in a helical pattern for the purpose of disturbing liquid flows in the separate chamber 410 to disperse the toner particles highly effectively. The dispersion is carried out more effectively by high-speed rotation of the brush roller 77.

According to a still further embodiment shown in FIGS. 8 through 11, a substantially cylindrical base 80 is fixed in a liquid developer contained in a separate chamber 410. A substantially cylindrical rotatable disk 81 is mounted on the fixed base 80 for slidable rotation thereon.

The rotatable disk 81 has a central hole 81H defined axially therethrough and coupled to a fixed pipe 83 through a coupling 82. The pipe 83 is connected through a pump P3 to a replenisher liquid developer tank or bottle 43.

A belt 84 is trained around a pulley integral with the upper shaft of the disk 81 and a pulley on the shaft of a motor M2. Thus, the disk 81 is rotated by the motor M2 through the belt 84.

A tapered plug 85 is threaded in the lower end of the pipe 83 and has a lower tapered end rotatably fitted in a tapered recess defined in the upper end of the shaft of the disk 81, the tapered plug 83 being covered with a cap nut 86. The cap nut 86 has a lower end threaded over the upper end of the shaft of the disk 81 and an upper end through which the tapered plug 85 is rotatably inserted.

When a signal is received from a density sensor in a developer tank, the pump P3 is started to supply a replenisher liquid developer of higher toner concentration from the tank 43 through the pipe 83, the tapered plug 85, and the disk 81 into a space between the disk 81 and the fixed base 80. At the same time, the motor M2 is operated to cause the belt 84 to rotate the disk 81 which is guided by an outer peripheral wall of the fixed base 80.

Figure 11:
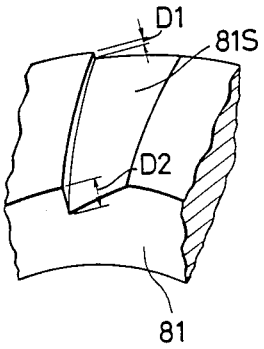

The disk 81 has a plurality of circumferentially spaced, substantially sectorial grooves 81S (FIG. 9) defined in its lower surface and extending spirally from the center toward the outer peripheral edge. As shown in FIG. 11, each of the grooves 81S has an outer edge stepped from the lower surface of the disk 81 by a distance D1 and an inner edge stepped from the lower disk surface by a distance D2, the distance D2 being larger than the distance D1. Such a difference between the distances D1, D2 may not necessarily be required.

Upon rotation of the disk 81, the replenisher liquid developer supplied under pressure by the pump P3 goes through the grooves 81S from the center toward the outer edge of the disk 81 and is discharged out through recesses 80M defined at spaced intervals in the outer peripheral wall of the fixed base 80. At this time, the replenisher liquid developer is sufficiently sheared and uniformly dispersed into the liquid developer in the separate chamber 410.

Figure 12:
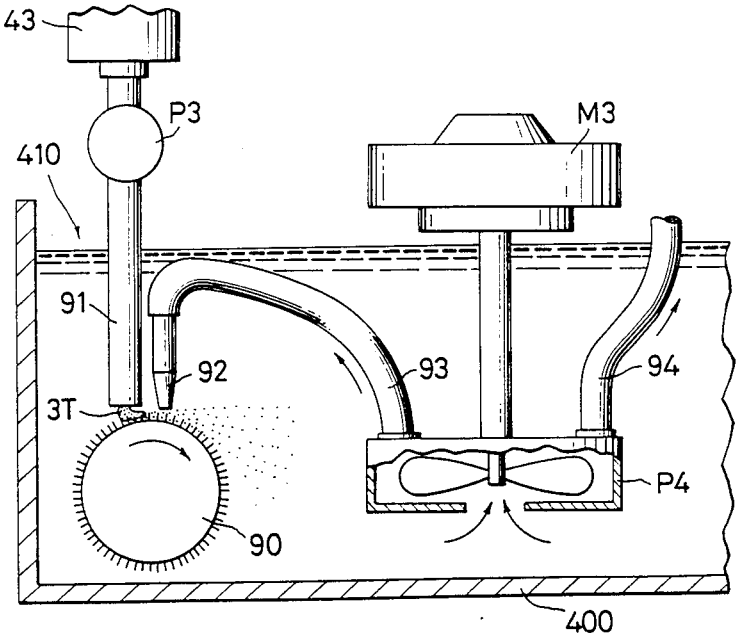
Figure 13:
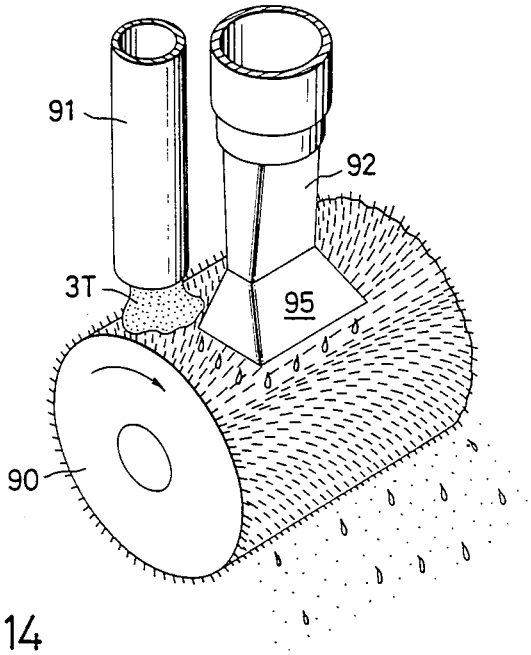
FIG. 13 is a perspective view of a portion of FIG. 12.

FIGS. 12 and 13 show a yet still further embodiment of the present invention. A pump P4 and a rotatable bristle brush roller 90 are disposed in a liquid developer contained in a separate chamber 410. The roller 90 has a brush of bristles on its outer peripheral surface and is rotatable clockwise in the direction of the arrow. A pipe 91 and a nozzle 92 are disposed above and directed toward the brush bristles of the roller 90. The pipe 91 is connected through a pump P3 to a tank or bottle 43 containing a replenisher liquid developer. The nozzle 92 is coupled to the outlet of a pump P4 through a pipe 93, the pump P4 being driven by a motor M3. The pump P4 has another outlet connected through a pipe 94 to a developer tank similar to the developer tank 50F shown in FIG. 3.

In response to a signal from a density sensor in the developer tank, the pump P3 is actuated to supply the replenisher liquid developer from the tank 43 onto the brush bristles of the roller 90 at 3T. The supplied replenisher liquid developer 3T rotates on and with the roller 90. As the replenisher liquid developer 3T reaches a position below the nozzle 92, a liquid developer under high pressure which is ejected from the nozzle 92 by the pump P4 is applied to the replenisher liquid developer 3T. The replenisher liquid developer 3T is dispersed into the liquid developer in the separate chamber 410 by vibration of the brush bristles due to ejection from the nozzle 92 and resistance from the liquid developer due to rotation of the roller 90. As shown in FIG. 13, the lower end of the nozzle 92 is connected to a nozzle cover 95.

Figure 14:
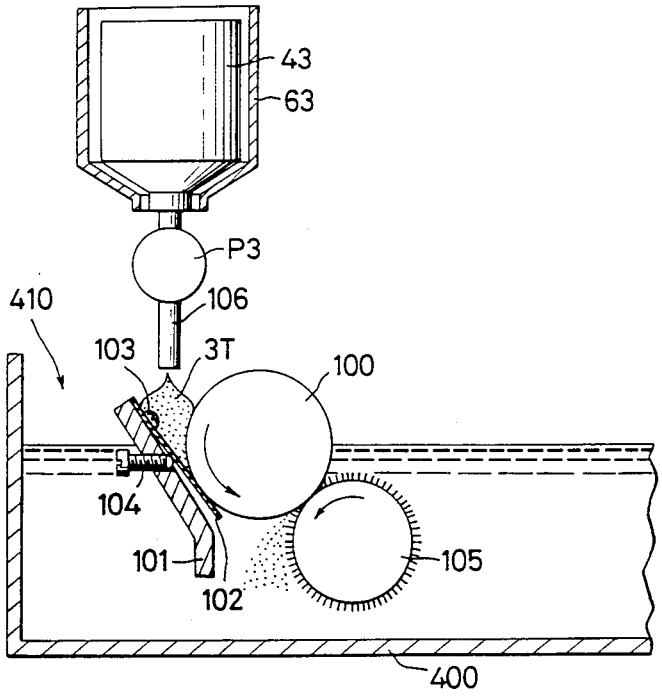
Figure 15:
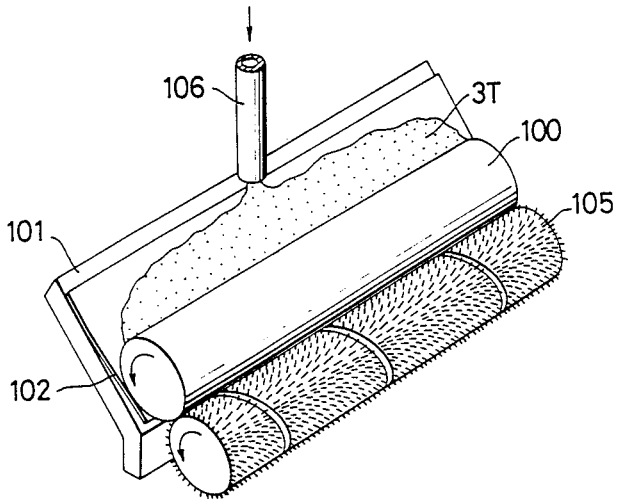
FIG. 15 is a perspective view of a portion of FIG. 14.

FIGS. 14 and 15 illustrate another embodiment of the present invention. A rotatable toner transfer roller 100 is partly immersed in a liquid developer contained in a separate chamber 410. A toner dispersing plate 101 extends longitudinally along the axis of the toner transfer roller 100, and a blade 102 is fixed along its upper edge to the toner dispersing plate 101 by means of screws 103. An adjustment screw 104 threaded through and across the toner dispersing plate 101 has its tip end held against a lower portion of the blade 102. Upon rotation of the adjustment screw 104, the blade 102 is elastically deformed to cause the lower free edge thereof to move toward and away from the toner transfer roller 100.

A brush bristle roller 105 is rotatably disposed beneath and pressed against the toner transfer roller 100 and immersed in the liquid developer, the roller 105 having bristles flocked on its outer peripheral surface. The roller 105 is rotatable by contact with the roller 100. A pipe 106 has its lower end open toward the area where the toner transfer roller 100 and the blade 102 are held in contact with each other. The pipe 106 is coupled through the pump P3 to a tank 43 containing a replenisher liquid developer of higher toner concentration.

When a signal is issued by a density sensor in the separate chamber 410, the pump P3 is operated to supply the replenisher liquid developer from the tank 43 through the pipe 106 onto the toner dispersing plate 101 and the blade 102 at 3T. The toner dispersing plate 101 serves to retain a certain amount of replenisher liquid developer 3T thereon and also to causes the blade 104 to adjust the amount of the replenisher liquid developer 3T which is transferred to the toner transfer roller 100.

The adjustment of the amount to be transferred of the replenisher liquid developer 3T is carried out by varying the clearance between the toner transfer roller 100 and the blade 102 through adjusting the pressed engagement of the adjustment screw 104 with the blade 102. Upon rotation of the toner transfer roller 100 in the direction of the arrow, the replenisher liquid developer 3T is converted to a thin film between the toner transfer roller 100 and the blade 102. The thin film of replenisher liquid developer is carried on the toner transfer roller 100 and then dispersed into the liquid developer in the separate chamber 410 by the bristle roller 105 rotating in contact with the toner transfer roller 100.

A plurality of pipes 106 may be disposed at fixed intervals so that the replenisher liquid toner will be uniformly supplied toward the toner transfer roller 100 and the blade 102.

As a modification, a porous rubber layer may be attached to the outer peripheral surface of the toner transfer roller 100 for retaining more liquid developer on the toner transfer roller 100.

According to still another embodiment, the pump P1 shown in FIG. 3 may be replaced with the pump 25 shown in FIG. 2. In this case, the pipes 5M, 20 (FIG. 2) coupled to the pump 25 are replaced with the pipes 45, 46 (FIG. 3) for returning the liquid developer into the separate chamber 410.

Figure 16:
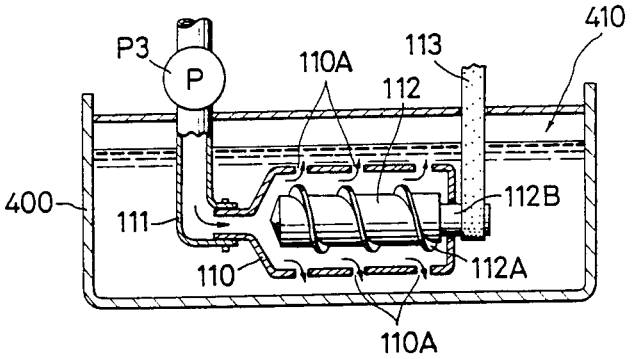

FIG. 16 shows yet still another embodiment of the present invention. A discharge member 110 immersed in a liquid developer contained in a separate chamber 410 has a bottle shape with one longitudinal end coupled to a pipe 111. The discharge member 110 has a plurality of small outlet ports 110A defined in its peripheral wall. A pair of rotatable spiral rollers 112 (only one shown) lying parallel to each other is disposed in the discharge member 110, each of the spiral rollers 112 having a spiral vane or fin 112A around its peripheral surface. The spiral rollers 112 have their axes extending longitudinally of the discharge member 110 and pulley ends 112B around which a drive belt 113 is trained.

For replenishing the separate chamber 410 with the replenisher liquid developer of higher toner concentration, the pump P3 is operated to supply the replenisher liquid developer under pressure from a tank (not shown) into the discharge member 110. At this time, the spiral rollers 112 are also rotated by the drive belt 113. The toner particles of the replenisher liquid developer fed to the discharge member 110 are broken up into smaller toner particles by the spiral rollers 112. The replenisher liquid developer is forced to move under pressure by the spiral rollers 112 and discharged out of the discharge member 110 through the outlet ports 110A.

The replenisher liquid developer discharged from the outlet ports 110A is well dispersed in the liquid developer in the separate chamber 410 when the replenisher liquid developer is expanded as it flows under pressure from the outlet ports 110A into the separate chamber 410.

Figure 17:
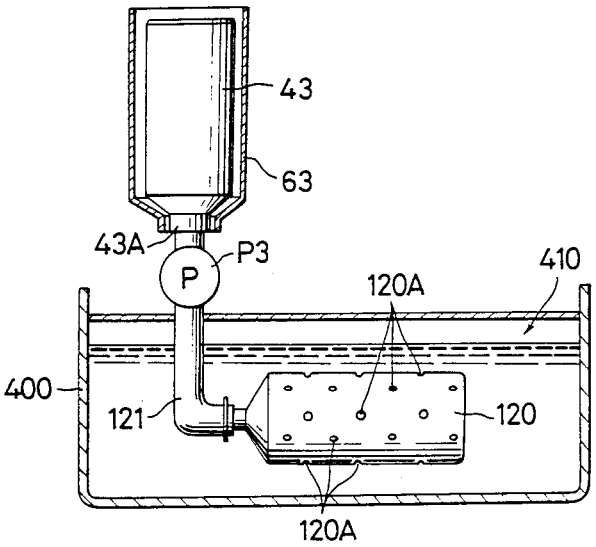
Figure 18:
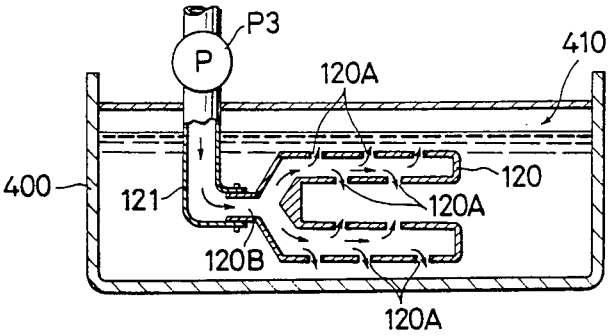
FIG. 18 is a cross-sectional view of FIG. 17.

According to a further embodiment of the present invention shown in FIGS. 17 and 18, a discharge member 120 immersed in a liquid developer in a separate chamber 410 is in the form of a pipe having a central recess and disposed horizontally, the discharge member 120 having a space therein for being filled with a replenisher liquid developer and a plurality of small outlet ports 120A defined in peripheral walls thereof.

The discharge member 120 has an opening 120B defined in one longitudinal end thereof and coupled to one end of a pipe 121, the other end of which is connected to a pump P3 joined to an opening 43A of a replenisher liquid developer tank 43.

The tank 43 is positioned near the separate chamber 410 and supported by a funnel-shaped holder 63 with its opening 43A directed downwardly.

When a replenisher liquid developer of higher toner concentration is to be supplied from the tank 43, the pump P3 is actuated to force the replenisher liquid developer from the tank 43 into the discharge member 120. As the replenisher liquid developer is discharged under pressure through the outlet ports 120A, it is expanded and well dispersed in the liquid developer in the separate chamber 410. The arrangement of FIGS. 17 and 18 is simple in construction because only the simple discharge member 120 is required to be connected to the pipe 121.

Figure 19:
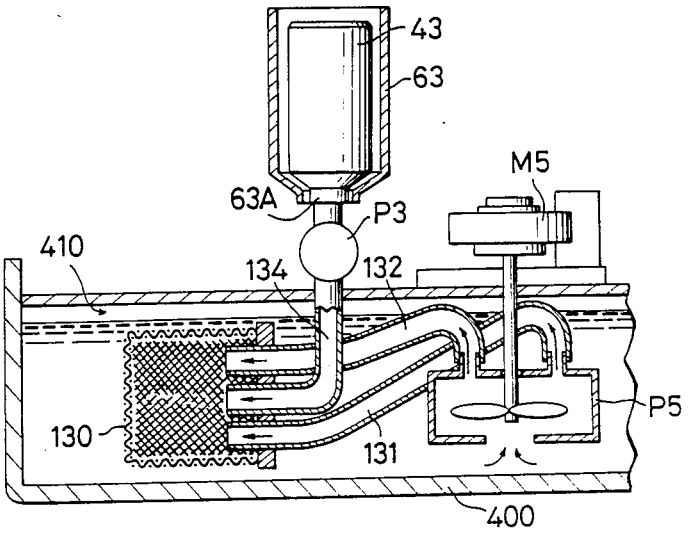

FIG. 19 shows a still further embodiment of the present invention. A separate chamber 410 contains a liquid developer in which a pump P5 and a mesh body 130 are immersed. The mesh body 130 is in the form of a casing comprising a mesh screen. The pump P5 is driven by a motor M5 and connected to outlet pipes 131, 132 having outlet ports positioned in the mesh body 130. Another pipe 134 has an outlet end positioned in the mesh body 130 and is connected at the other end to a pump P3 with its inlet coupled to a downward opening 63A of a replenisher liquid developer tank 43 held by a funnel-shaped tank holder 63. The tank 43 contains a replenisher liquid developer of higher toner concentration.

In operation, the pump P3 is driven to supply the replenisher liquid developer from the tank 43 through the pipe 134 into the mesh body 130. At the same time, the pump P5 is rotated by the motor M5 to eject the liquid developer in the separate chamber 410 through the pipes 131, 132 as jet flows into the mesh body 130. The replenisher liquid developer in the mesh body is then well dispersed by the jet flows into the liquid developer in the separate chamber 410. Any replenisher liquid developer which is not well dispersed is forced against the mesh screen of the mesh body 130 by the jet flows from the pipes 131, 132, and is sufficiently dispersed by the mesh screen and the jet flows into the liquid developer.

Figure 20:
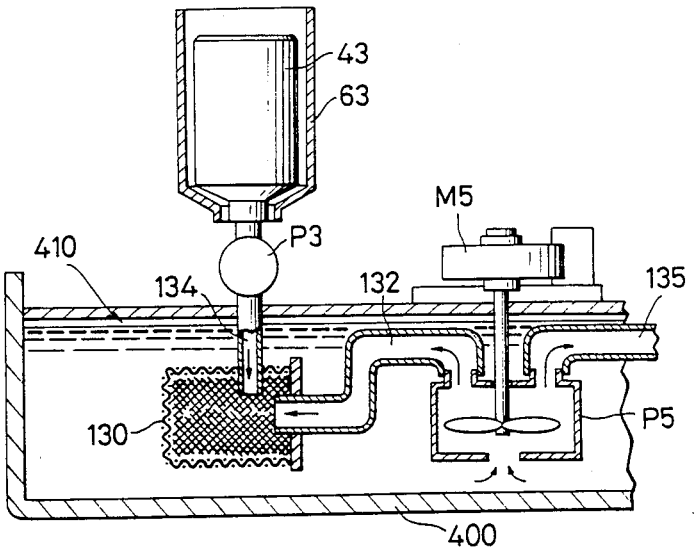

FIG. 20 illustrates a yet still further embodiment of the present invention. A pipe 134 from a pump P3 and a pipe 132 from a pump P5 have outlet ends disposed perpendicularly to each other in a mesh body 130 immersed in a liquid developer in a separate chamber 410. The pump P5 has another outlet port connected to a pipe 135 which opens into a developer tank similar to the developer tank 50F shown in FIG. 3.

A replenisher liquid developer of higher toner concentration is supplied by the pump P3 through the pipe 134 into the mesh body 130, while at the same time a jet of liquid developer is discharged by the pump P5 driven by a motor M5 through the pipe 132 into the mesh body 130 so as to hit transversely the replenisher liquid developer from the pipe 134, which is then well dispersed in the liquid developer. Any replenisher liquid developer which is not well dispersed is brought against the mesh screen of the mesh body 130 and sufficiently dispersed by the mesh screen under the force of the jet flow from the pipe 132.

In FIGS. 19 and 20, the outlet end of the pipe 134 should be placed in the liquid developer since if it were exposed to air, the toner of the replenisher liquid developer supplied therefrom would be solidified to clog the pipe 134, thus failing to supply the replenisher liquid developer or increasing the load on the pump P3.

In each of the above embodiments, the toner particles in the replenisher liquid developer are broken up by the dispersing means into smaller toner particles having a diameter ranging from 0.3 to 0.6 micrometer so that the toner particles will have a wider surface area. The replenisher liquid developer is uniformly dispersed in the liquid developer within a reduced period of time by the dispersing means which is relatively simple in structure.

While the dispersing means in each of the embodiments shown in FIGS. 4, 5, 6–7, 8–11, 12–13, 14–15, 16, 17–18, 19, and 20 is disposed in the separate chamber 410, it may be directly mounted in the developer tank 30 shown in FIG. 1. In such a modified arrangement, the pipe 94 shown in FIG. 12 and the pipe 135 shown in FIG. 13 are replaced with the supply pipe 20 shown in FIG. 1.

While an electrophotographic copying machine has been exemplified, the principles of this invention are also applicable to other devices such as printers, facsimile transmitters/receivers, or the like which employ the wet-type image developing system.

Although certain preferred embodiments have been shown and described, it should be understood that many changes and modifications may be made therein without departing from the scope of the appended claims.

What is claimed is:

1. An electrostatic copying machine, equipped with a developer tank for use with a developing replenisher material capable of being supplied to said developer tank, said replenisher material comprising 100 parts by weight of a carrier liquid composed mainly of an aliphatic hydrocarbon, and 200 to 1200 parts by weight of toner particles composed mainly of a binder resin and a pigment;

wherein said developer tank comprises a container for storing a liquid developer, and has dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

wherein said dispersing means comprises a pump disposed in said developer tank and having inlet and outlet ports opening in said developer tank, said liquid developer supply means comprising said pump disposed in said developer tank and a liquid developer supply pipe connecting an outlet port of said pipe to said liquid developer supply, said inlet port of said pump communicating through a pipe with a replenisher tank for containing the developing replenisher material;

wherein said outlet port of said pump and said pipe are interconnected with a mesh screen disposed therebetween across a passage extending between said outlet port of said pump and said pipe.

2. An electrostatic copying machine, equipped with a developer tank for use with a developing replenisher material capable of being supplied to said developer tank, said replenisher material comprising 100 parts by weight of a carrier liquid composed mainly of an aliphatic hydrocarbon, and 200 to 1200 parts by weight of toner particles composed mainly of a binder resin and a pigment;

wherein said developer tank comprises a container for storing a liquid developer, and has dispersing means for dispersing said developing replenisher material in said liquid developer, said developer tank being connected to a liquid developer supply through liquid developer supply means and a liquid developer retrieval means, said liquid developer supply means being disposed around a rotatable latent image carrier for applying the liquid developer to said latent image carrier;

wherein said dispersing means comprises a pump disposed in said developer tank and having inlet and outlet ports opening in said developer tank, said liquid developer supply means comprising said pump disposed in said developer tank and a liquid developer supply pipe connecting an outlet port of said pipe to said liquid developer supply, said inlet port of said pump communicating through a pipe with a replenisher tank for containing the developing replenisher material;

wherein said developer tank has a separate chamber defined by a partition therein, further including a first replenisher tank having a first container for containing the developing replenisher material and a pipe communicating said first container with said separate chamber, a second replenisher tank having a second container for containing a replenisher carrier liquid and a pipe communicating said second container with said separate chamber, dispersing means for dispersing the developing replenisher material in the liquid developer, and discharge means for delivering the liquid developer from said separate chamber into said developer tank.

3. An electrostatic copying machine according to claim 2, wherein said dispersing means comprises a pump having an inlet port opening in said separate chamber and an outlet port, and a pipe connected to said outlet port of the pump and opening in said separate chamber.

4. An electrostatic copying machine according to claim 2, wherein said pipe communicating said first container with said separate chamber has an outlet port connected to the inlet port of said pump, said outlet port of said pump opening in said separate chamber.

5. An electrostatic copying machine according to claim 2, wherein said dispersing means comprises a cylindrical member of a mesh structure connected to an outlet of said pipe of said first replenisher tank, and a bristle brush rotatable in said cylindrical member.

6. An electrostatic copying machine according to claim 2, wherein said dispersing means comprises a pair of spongerollers disposed at an outlet port of the pipe of said second replenisher tank and pressed against each other, said sponge rollers being rotatable about their own axes such that pressed surfaces thereof will move downwardly.

7. An electrostatic copying machine according to claim 6, wherein said dispensing means further includes a pair of smaller-diameter squeeze rollers pressed respectively against said sponge rollers, said squeeze rollers being rotatable about their own axes such that surfaces pressed against the sponge rollers will move in directions opposite to the directions in which confronting surfaces of the sponge rollers move.

8. An electrostatic copying machine according to claim 6, wherein said outlet of said pipe comprises a plurality of branched nozzles spaced along the pressed surfaces of said sponge rollers.

9. An electrostatic copying machine according to claim 2, wherein said dispersing means comprises a pair of rotatable rollers disposed in the liquid developer contained in said developer tank and spaced from each other, a mesh belt trained around said rollers, and a plate disposed within said belt and near a run of said belt and having flocked fibers held against said run of the belt, said outlet of the pipe being positioned adjacent to another run of said belt between said rollers, a fixed blade disposed downstream of said outlet of the pipe in a direction of travel of said belt and spaced slightly from said belt, and a bristle brush roller rotatable by contact with the roller which is close to said blade.

10. An electrostatic copying machine according to claim 2, wherein said dispersing means comprises a substantially cylindrical fixed base disposed in the liquid developer contained in said developer tank, a rotatable disk slidably rotatable in contact with an upper surface of said fixed base, and means for rotating said rotatable disk, said rotatable disk having a central hole defined axially therethrough and connected to an outlet of the pipe of said first replenisher tank.

11. An electrostatic copying machine according to claim 2, wherein said rotatable disk has a plurality of substantially sectorial grooves defined in a surface thereof facing said fixed base and extending spirally from a central portion of the disk toward an outer peripheral edge thereof.

12. An electrostatic copying machine according to claim 2, wherein said fixed base has an outer peripheral wall having a plurality of circumferentially space recesses.

13. An electrostatic copying machine according to claim 2, wherein said dispersing means comprises a bristle brush roller rotatably disposed in the liquid developer contained in said developer tank, and a nozzle and a pipe disposed adjacent to and opening above said bristle brush roller, said nozzle being connected to an outlet port of a pump for drawing and discharging the liquid developer in said developer tank, said last-mentioned pipe being coupled to said pipe of said first replenisher tank.

14. An electrostatic copying machine according to claim 2, wherein said dispersing means comprises a rotatable toner transfer roller partly disposed in the liquid developer contained in said developer tank, a toner dispersing plate extending along an axis of said toner transfer roller, a blade having one end fixed to an upper portion of said toner dispersing plate and an opposite free end pressed against said toner transfer roller, and a bristle brush roller disposed beneath and pressed against said toner transfer roller in said liquid developer, said bristle brush roller being rotatable by contact with said toner transfer roller, said pipe of said first replenisher tank having an outlet port opening above an area in which said blade and said toner transfer roller are held against each other.

15. An electrostatic copying machine according to claim 2 wherein said dispersing means comprises a bottle-shaped discharge member fixedly disposed in the liquid developer contained in said developer tank and having a plurality of small outlet ports defined in a peripheral wall thereof, and a spiral roller rotatably disposed in said discharge member, said discharge member being connected to said pipe of said first replenisher tank.

16. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of toner particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a cylindrical member of a mesh structure connected to the outlet port of the pipe of said first replenisher tank, and a bristle brush rotatable in said cylindrical member, said cylindrical member being disposed in said developer tank.

17. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of tone particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a pair of sponge rollers disposed at an outlet port of the pipe of said second replenisher tank and pressed against each other, said sponge rollers being rotatable about their own axes such that pressed surfaces thereof will move downwardly.

18. An electrostatic copying machine according to claim 17, wherein said dispersing means further includes a pair of smaller-diameter squeeze rollers pressed respectively against said sponge rollers, said squeeze rollers being rotatable about their own axes such that surfaces pressed against the sponge rollers will move in directions opposite to the directions in which confronting surfaces of the sponge rollers move.

19. An electrostatic copying machine according to claim 17, wherein said outlet of said pipe comprises a plurality of branched nozzles spaced along the pressed surfaces of said sponge rollers.

20. An electrostatic copying machine according to claim 17, wherein said dispersing means comprises a pair of rotatable rollers disposed in the liquid developer contained in said developer tank and spaced from each other, a mesh belt trained around said rollers, and a plate disposed within said belt and near a run of said belt and having flocked fibers held against said run of the belt, said outlet of the pipe being positioned adjacent to another run of said belt between said rollers.

21. An electrostatic copying machine according to claim 20, wherein said dispensing means further includes a fixed blade disposed downstream of said outlet of the pipe in a direction of travel of said belt and spaced slightly from said belt, and a bristle brush roller rotatable by contact with the roller which is close to said blade.

22. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of toner particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a substantially cylindrical fixed base disposed in the liquid developer contained in said developer tank, a rotatable disk slidably rotatable in contact with a upper surface of said fixed base, and means for rotating said rotatable disk, said rotatable disk having a central hole defined axially therethrough and connected to an outlet of the pipe of said first replenisher tank.

23. An electrostatic copying machine according to claim 22, wherein said rotatable disk has a plurality of substantially sectorial grooves defined in a surface thereof facing said fixed base and extending spirally from a central portion of the disk toward an outer peripheral edge thereof.

24. An electrostatic copying machine according to claim 22, wherein said fixed base has an outer peripheral wall having a plurality of circumferentially space recesses.

25. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of toner particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bristle brush roller rotatably disposed in the liquid developer contained in said developer tank, and a nozzle and a pipe disposed adjacent to and opening above said bristle brush roller, said nozzle being connected to an outlet port of a pump for drawing and discharging the liquid developer in said developer tank, said last-mentioned pipe being coupled to said pipe of said first replenisher tank.

26. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of toner particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a rotatable toner transfer roller partly disposed in the liquid developer contained in said developer tank, a toner dispersing plate extending along an axis of said toner transfer roller, a blade having one end fixed to an upper portion of said tone dispersing plate and an opposite free end pressed against said toner transfer roller, and a bristle brush roller disposed beneath and pressed against said toner transfer roller in said liquid developer, said bristle roller being rotatable by contact with said toner transfer roller, said pipe of said first replenisher tank having an outlet port opening above an area in which said blade and said toner transfer roller are held against each other.

27. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of toner particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bottle-shaped discharge member fixedly disposed in the liquid developer container in said developer tank and having a plurality of small outlet ports defined in a peripheral wall thereof, and a spiral roller rotatably disposed in said discharge member, said discharge member being connected to said pipe of said first replenisher tank.

28. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of toner particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bottle-shaped discharge member fixedly disposed in the liquid developer container in said developer tank and having a plurality of small outlet ports defined in a peripheral wall thereof, said discharge member being connected to said pipe of said first replenisher tank.

29. An electrostatic copying machine, having a developer tank, for use with a developing replenisher material capable of being supplied to a developer tank of an image forming device, comprising 1000 parts by weight of a carrier liquid composed mainly of an aliphatic hydrocarbon and 200 to 1200 parts by weight of toner particles composed mainly of a binder resin and a pigment;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises an outlet port of said pipe of said first replenisher tank, an outlet port of a pipe connected to an outlet port of a pump for discharging the liquid developer in said developer tank, and a mesh body disposed in the liquid developer in said developer tank, said outlet ports being disposed in said mesh body.

30. An electrostatic copying machine having a developer tank for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

wherein said dispersing means comprises a pump disposed in said developer tank and having inlet and outlet ports opening in said developer tank, said liquid developer supply means comprising said pump disposed in said developer tank and a liquid developer supply pipe connecting an outlet port of said pipe to said liquid developer supply, said inlet port of said pump communicating through a pipe with a replenisher tank for containing the developing replenisher material;

wherein said outlet port of said pump and said pipe are interconnected with a mesh screen disposed therebetween across a passage extending between said outlet port of said pump and said pipe.

31. An electrostatic copying machine having a developer tank for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

wherein said dispersing means comprises a pump disposed in said developer tank and having inlet and outlet ports opening in said developer tank, said liquid developer supply means comprising said pump disposed in said developer tank and a liquid developer supply pipe connecting an outlet port of said pipe to said liquid developer supply, said inlet port of said pump communicating through a pipe with a replenisher tank for containing the developing replenisher material;

wherein said outlet port of said pump and said pipe are interconnected with a mesh screen disposed therebetween across a passage extending between said outlet port of said pump and said pipe.

32. An electrostatic copying machine having a developer tank for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

wherein said dispersing means comprises a pump disposed in said developer tank and having inlet and outlet ports opening in said developer tank, said liquid developer supply means comprising said pump disposed in said developer tank and a liquid developer supply pipe connecting an outlet port of said pipe to said liquid developer supply, said inlet port of said pump communicating through a pipe with a replenisher tank for containing the developing replenisher material;

wherein said developer tank has a separate chamber defined by a partition therein, further including a first replenisher tank having a first container for containing the developing replenisher material and a pipe communicating said first container with said separate chamber, a second replenisher tank having a second container for containing a replenisher carrier liquid and a pipe communicating said second container with said separate chamber, dispersing means for dispersing the developing replenishing material in the liquid developer, and discharge means for delivering the liquid developer from said separate chamber into said developer tank.

33. An electrostatic copying machine having a developer tank for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of tone composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

wherein said dispersing means comprises a pump disposed in said developer tank and having inlet and outlet ports opening in said developer tank, said liquid developer supply means comprising said pump disposed in said developer tank and a liquid developer supply pipe connecting an outlet port of said pipe to said liquid developer supply, said inlet port of said pump communicating through a pipe with a replenisher tank for containing the developing replenisher material;

wherein said developer tank has a separate chamber defined by a partition therein, further including a first replenisher tank having a first container for containing the developing replenisher material and a pipe communicating said first container with said separate chamber, a second replenisher tank having a second container for containing a replenisher carrier liquid and a pipe communicating said second container with said separate chamber, dispersing means for dispersing the developing replenisher material in the liquid developer, and discharge means for delivering the liquid developer from said separate chamber into said developer tank.

34. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a cylindrical member of a mesh structure connected to the outlet port of the pipe of said first replenisher tank, and a bristle brush rotatable in said cylindrical member, said cylindrical member being disposed in said developer tank.

35. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a cylindrical member of a mesh structure connected to the outlet port of the pipe of said first replenisher tank, and a bristle brush rotatable in said cylindrical member, said cylindrical member being disposed in said developer tank.

36. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a pair of sponge rollers disposed at an outlet port of the pipe of said second replenisher tank and pressed against each other, said sponge rollers being rotatable about their own axes such that pressed surfaces thereof will move downwardly.

37. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a pair of sponge rollers disposed at an outlet port of the pipe of said second replenisher tank and pressed against each other, said sponge rollers being rotatable about their own axes such that pressed surfaces thereof will move downwardly.

38. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a substantially cylindrical fixed base disposed in the liquid developer contained in said developer tank, a rotatable disk slidably rotatable in contact with an upper surface of said fixed base, and means for rotating said rotatable disk, said rotatable disk having a central hole defined axially therethrough and connected to an outlet of the pipe of said first replenisher tank.

39. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said delevoper tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a substantially cylindrical fixed base disposed in the liquid developer contained in said developer tank, a rotatable disk slidably rotatable in contact with an upper surface of said fixed base, and means for rotating said rotatable disk, said rotatable disk having a central hole defined axially therethrough and connected to an outlet of the pipe of said first replenisher tank.

40. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispensing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bristle brush roller rotatably disposed in the liquid developer contained in said developer tank, and a nozzle and a pipe disposed adjacent to and opening above said bristle brush roller, said nozzle being connected to an outlet port of a pump for drawing sand discharging the liquid developer in said developer tank, said last-mentioned pipe being coupled to said pipe of said first replenisher tank.

41. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bristle brush roller rotatably disposed in the liquid developer contained in said developer tank, and a nozzle and a pipe disposed adjacent to and opening above said bristle brush roller, said nozzle being connected to an outlet port of a pump for drawing and discharging the liquid developer in said developer tank, said last-mentioned pipe being coupled to said pipe of said first replenisher tank.

42. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a rotatable toner transfer roller partly disposed in the liquid developer containing in said developer tank, a toner dispersing plate extending along an axis of said toner transfer roller, a blade having one end fixed to an upper portion of said toner dispersing plate and an opposite free end pressed against said toner transfer roller, and a bristle brush roller disposed beneath and pressed against said toner transfer roller in said liquid developer, said bristle brush roller being rotatable by contact with said toner transfer roller, said pipe of said first replenisher tank having an outlet port opening above an area in which said blade and said toner transfer roller are held against each other.

43. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a rotatable toner transfer roller partly disposed in the liquid developer contained in said developer tank, a toner dispersing plate extending along an axis of said toner transfer roller, a blade having one end fixed to an upper portion of said toner dispersing plate and an opposite free end pressed against said toner transfer roller, and a bristle brush roller disposed beneath and pressed against said toner transfer roller in said liquid developer, said bristle brush roller being rotatable by contact with said toner transfer roller, said pipe of said first replenisher tank having an outlet port opening above an area in which said blade and said toner transfer roller are held against each other.

44. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bottle-shaped discharge member fixedly disposed in the liquid developer contained in said developer tank and having a plurality of small outlet ports defined in a peripheral wall thereof, and a spiral roller rotatably disposed in said discharge member, said discharge member being connected to said pipe of said first replenisher tank.

45. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bottle-shaped discharge member fixedly disposed in the liquid developer container in said developer tank and having a plurality of small outlet ports defined in a peripheral wall thereof, and a spiral roller rotatably disposed in said discharge member, said discharge member being connected to said pipe of said first replenisher tank.

46. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bottle-shaped discharge member fixedly disposed in the liquid developer contained in said developer tank and having a plurality of small outlet ports defined in a peripheral wall thereof, said discharge member being connected to said pipe of said first replenisher tank.

47. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder resin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises a bottle-shaped discharge member fixedly disposed in the liquid developer contained in said developer tank and having a plurality of small outlet ports defined in a peripheral wall thereof, said discharge member being connected to said pipe of said first replenisher tank.

48. An electrostatic copying machine, having a developer tank, for use with a developing replenisher material capable of being supplied to a developer tank of an image forming device, comprising a carrier liquid composed mainly of an aliphatic hydrocarbon and at least one of a resin dissolvable in the aliphatic hydrocarbon and a charge controlling agent;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises an outlet port of said pipe of said first replenisher tank, an outlet port of a pipe connected to an outlet port of a pump for discharging the liquid developer in said developer tank, and a mesh body disposed in the liquid developer in said developer tank, said outlet ports being disposed in said mesh body.

49. An electrostatic copying machine, having a developer tank, for use with a developing replenisher material capable of being supplied to a developer tank of an image forming device, comprising 100 parts by weight of a carrier liquid composed mainly of an aliphatic hydrocarbon wherein at least 500 weight % thereof has a boiling point of 190° C. or higher, 200 to 1200 parts by weight of toner composed mainly of a binder rosin and a pigment and dispersed in said carrier liquid, said developing replenisher material being used in combination with another carrier liquid composed mainly of aliphatic hydrocarbon and at least one of a resin dissolvable in the aliphatic hydrocarbon and a charge controlling agent, said latter aliphatic hydrocarbon having a boiling point ranging from 120° C. to 190° C.;

wherein said developer tank comprises a container for storing a liquid developer, and has a dispersing means for dispersing said developing replenisher material in said liquid developer, said developer tank being connected to a liquid developer supply through a liquid developer supply means and a liquid developer retrieval means, said liquid developer supply means being disposed around a rotatable latent image carrier for applying the liquid developer to said latent image carrier;

further including a first replenisher tank having a first container for containing the developing replenisher material and a pipe communicating said first container with said developer tank, and a second replenisher tank having a second container for containing a replenisher carrier liquid and a pipe communicating said second container with said developer tank;

wherein said dispersing means comprises an outlet port of said pipe of said first replenisher tank, an outlet port of a pipe connected to an outlet port of a pump for discharging the liquid developer in said developer tank, and a mesh body disposed in the liquid developer in said developer tank, said outlet ports being disposed in said mesh body.

50. A developing replenisher material capable of being supplied to a developer tank of an electrostatic copying machine, comprising a carrier liquid composed mainly of an aliphatic hydrocarbon and at least one resin dissolvable in the aliphatic hydrocarbon and a charge controlling agent, and capable of being added to a developer replenisher material comprising 1000 parts by weight of a carrier liquid composed mainly of aliphatic hydrocarbon and 200 to 1200 parts by weight of toner particles composed mainly of a binder resin and a pigment.

51. A developing device for an electrostatic copying machine comprising:

a developer tank storing a liquid developer for developing electrostatic latent images;

a concentrated replenisher liquid developer tank storing a developing replenisher material comprising 1000 parts by weight of carrier liquid composed mainly of aliphatic hydrocarbon and 200 to 1200 parts by weight of toner particles composed mainly of a binder resin and a pigment;

a means for supplying said concentrated replenisher liquid developer to said developer tank from said concentrated replenisher liquid developer tank when the density of said toner in said liquid developer is lowered; and a means for supplying a developer replenisher material comprising a carrier liquid composed mainly of aliphatic hydrocarbon and at least one resin dissolvable in the aliphatic hydrocarbon and a charge controlling agent when the carrier particles in said liquid developer becomes short.

52. A developing method for an electrostatic copying machine comprising the steps of:

providing a liquid developer with a developing replenisher material comprising 1000 parts by weight of a carrier liquid composed mainly of aliphatic hydrocarbon and 200 to 1200 parts by weight of toner particles composed mainly of a binder resin and a pigment when the density of said toner in said liquid developer is lowered; and providing said liquid developer with a developing replenisher material comprising a carrier liquid composed mainly of aliphatic hydrocarbon and at least one resin dissolvable in the aliphatic hydrocarbon and a charge controlling agent when the carrier particles in said liquid developer become short.

* * * * *